United States Patent [19]

David

[11] Patent Number: 4,580,356

[45] Date of Patent: Apr. 8, 1986

[54] REMOVABLE INSOLES

[76] Inventor: Loic David, Chemin des Prairies, Le Grand Lemps, France, F-38690

[21] Appl. No.: 598,289

[22] PCT Filed: Jul. 18, 1983

[86] PCT No.: PCT/FR83/00146

§ 371 Date: Mar. 15, 1984

§ 102(e) Date: Mar. 15, 1984

[87] PCT Pub. No.: WO84/00481

PCT Pub. Date: Feb. 16, 1984

[30] Foreign Application Priority Data

Jul. 23, 1982 [FR] France ..... 82 13049

[51] Int. Cl.[4] ..... A43B 13/38

[52] U.S. Cl. ..... 36/43

[58] Field of Search ..... 36/88, 91, 93, 43, 44

[56] References Cited

U.S. PATENT DOCUMENTS

| | | | |
|---|---|---|---|
| 873,775 | 12/1907 | Nathan | 36/43 X |
| 2,713,215 | 7/1955 | Cosneck | 36/44 |
| 3,084,695 | 4/1963 | O'Donnell | 128/615 |
| 3,892,077 | 7/1975 | Wolstenholme | 36/44 |
| 4,115,934 | 9/1978 | Hall | 36/44 |
| 4,186,499 | 2/1980 | Massok, Jr. et al. | 36/44 |
| 4,317,298 | 3/1982 | Sigle et al. | 36/43 |

FOREIGN PATENT DOCUMENTS

| | | | |
|---|---|---|---|
| 2335171 | 7/1977 | France | 36/88 |
| 2011243 | 7/1979 | United Kingdom | 36/43 |

*Primary Examiner*—Werner H. Schroeder
*Assistant Examiner*—T. Graveline
*Attorney, Agent, or Firm*—Handal & Morofsky

[57] ABSTRACT

The removable insole for shoes consists of a thin strip (1) of plastic foam, such as polyolefin foam, in the general shape of the foot.

This strip (1) has grooves (6, 7, 8) which are located at the edge of the insole or delimiting zones (3, 4, 5) on the insole which are of different thicknesses, and thus of different densities. The edge of the insole is bevelled (9, 10).

The insole (1) gradually becomes permanently deformed on contact with the foot and finally adopts the profile thereof. The grooves (6, 7, 8) allow the insole to change shape more easily.

8 Claims, 4 Drawing Figures

REMOVABLE INSOLES

The present invention relates to a removable insole for shoes, the original profile of which is flat or curved, and which gradually becomes permanently deformed on contact with the foot and finally adopts the profile thereof Insoles are known, the profiles of which are shaped on the morphology of the foot, and which are particularly used in sports shoes such as ski boots or mountaineering boots. These insoles are manufactured in particular from a material which is deformable under heat and they require a relatively costly and bulky shaping material to be used. Moreover, besides the fact that these insoles are quite thick, once inside the shoe they cannot be removed and generally constitute an integral part thereof.

To enable insoles of this type to be used in everyday shoes, it would be necessary to substantially reduce their thickness on the one hand and on the other hand to make them removable. What is feasible for sports shoes, which are bought on a relatively small scale each season and which generally last for several years, would be prohibitive for everday shoes more of which are used for relatively short periods of time.

The present inventions sets out to solve the preceding problem, by providing a removable insole for shoes, the original profile of which is flat or curved. This insole consists of a thin strip of plastic foam in the general shape of the foot which gradually becomes permanently deformed on contact with the foot and finally adopts the profile thereof. This strip has a groove along at least part of its edge and inside this edge, which groove is intended to allow the insole to change shape more easily.

The strip may also have other grooves which do not follow the line of the edge, such as arc-shaped grooves which begin and end at the edge.

It should be noted that at certain points the grooves delimit zones which may be of equal density or of different densities.

Thus, the zones of different densities advantageously correspond to the zones of different thicknesses which are caused, for example, by pressure on a thin strip.

The strip may also have two distinct zones which are delimited by an arc-shaped groove, that is a main zone and a zone at the arch of the foot which may be of the same or of a different density.

The strip preferably has three distinct zones, that is a substantially central main zone and two zones, one of which corresponds to the arch of the foot and the second of which corresponds to the outer toes. The density of these two zones is greater than that of the central zone which forms the rest of the insole. In a variant, the density of the central zone is the same as that of the zone of the toes.

The edges of the insole are preferably bevelled.

The purpose of the different grooves is to allow the insole to change shape more easily by creating lines of weakness and by preventing the insole from puckering as a result of the deformation process.

The insole may be manufactured in any deformable material, preferably in a material which becomes deformed under heat, such as polyolefinic foams and in particular polyolefins which have closed cells. Examples of materials of this type are polyethylenes, polypropylenes, polybutylenes and polyisobutylenes. The thickness of the strip which forms the insole is advantageously from 2 to 5 mm.

The insole may have an original profile which is flat or curved, so as to be pre-profiled in the general shape of the foot.

The insole may be placed into the shoe as it is and adopt its permanent shape by becoming deformed under heat, simply by the heat which is generated by the feet. To ensure that the insole is properly in place and accelerate the process, it is generally preferred to preheat the insole before it is placed in the shoe.

In a variant, the insole is moulded around the foot outside the shoe. The insole is placed in the shoe to remain therein or to be removed, but only after adopting its permanent profile, which is that of the foot.

The invention will be more clearly understood with reference to the accompanying drawings, which are given as Examples. As is shown, the grooves are made on the lower side of the insole, the side of the shoe, but it should be noted that the grooves can be made just as well on the upper side of the insole, the side of the foot.

Figure 1:
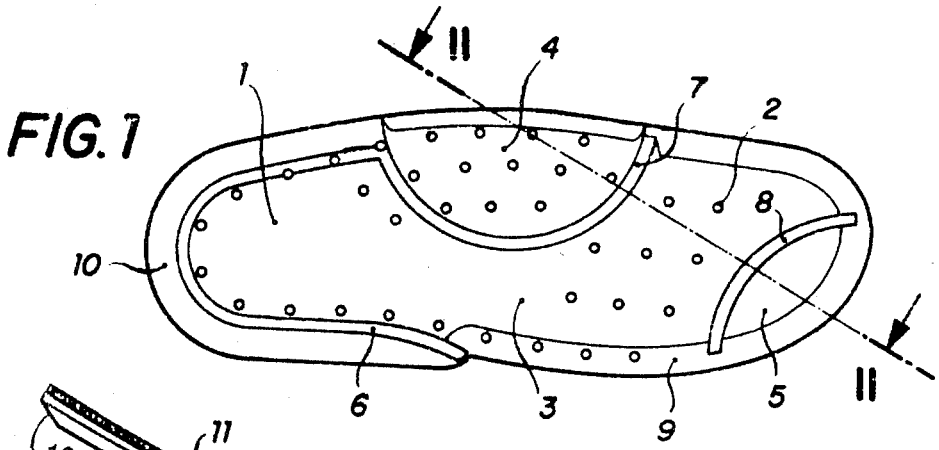
FIG. 1 shows a bottom view of the insole, which has an original flat profile.

FIG. 1 shows the bottom side of a new insole, that is an insole which has not yet taken the shape of the profile of the foot. This insole is made from a strip 1 of a plastic foam, such as polyethylene. This strip 1 is pierced with pores 2 and comprises three distinct zones of different thicknesses, 3, 4 and 5. Zone 3 which is of a lesser thickness than zones 4 and 5 and hence of a greater density, acts as a supporting zone for the foot. Zone 4 which is of a slightly greater thickness and thus of a slightly lower density, corresponds to the instep of the foot and is intended to fit the shape of the arch of the foot. Zone 5 which is thicker and thus not as dense as zone 3 acts as a supporting zone for the toes, and particularly the smaller toe.

For greater simplification, zones 4 and 5 are advantageously of the same thickness and thus of the same density.

In a variant zones 3 and 5 are of the same thickness and thus of the same density.

In a variant, the central zone 3 may have, at the heel level, a zone which is not shown and is not very thick and is thus of a greater density. This zone is intended principally to support the heel which is subjected to the greatest stresses. This zone may also be advantageously used for the printing of a trade mark.

A groove 6 is located in the border area of the strip, in the rear zone, and grooves 7, 8 are arranged between zones 3, 4 and 5 which are of different thicknesses. Without it being absolutely necessary, the edge of the insole is bevelled 9, 10.

Figure 2:
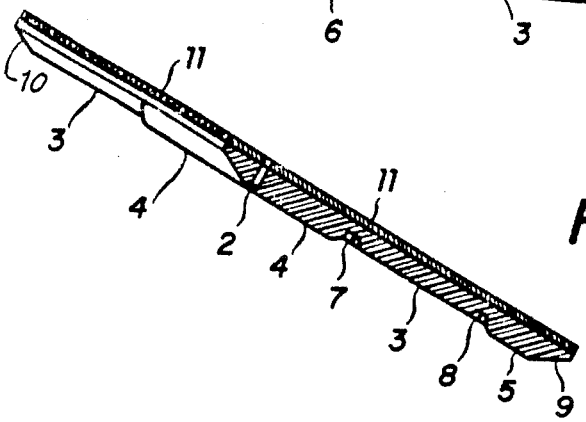
FIG. 2 shows a cross-section, along II—II, of FIG. 1, after it is pivoted towards the front of the strip along an axis which is parallel to II—II through the heel.

In the cross-section view which is shown in FIG. 2, the same elements as before can be seen, indicated by the same numbers. The section is made along axis II—II of FIG. 1 and only relates to the front section of the insole, showing the zones of different thicknesses, that is respectively 3, 4 and 5. The upper side of the insole, that is the side which comes into contact with the foot, is turned upwards and covered with a thin anti-perspirant, anti-odor layer 11. This thin layer is, however, not absolutely necessary.

Figure 3:
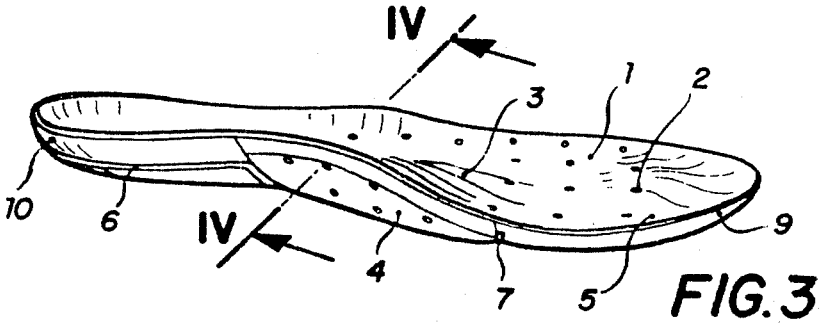
FIG. 3 shows a view in perspective of the insole which has adopted the profile of the foot.

In FIG. 3, the insole is shown as it would look in the shoe after it has become deformed by the foot of the wearer. In order to show this more clearly, the insole is drawn without the anti-perspirant layer.

To become deformed in this manner, the insole shown in FIG. 1 is placed, after preheating, for example, in the shoe of the wearer who then walks on it. The insole becomes deformed by adopting the profile of the foot and the shoe on account of the nature of the constituent material. Moreover, the insole may change shape more easily by the grooves 6, 7 and 8, the bevelling 9 and 10 contributing to greater comfort. It should be noted that this insole, when deformed, does not pucker.

The depth of the grooves is advantageously from 15 to 50% of the thickness of the strip 1.

Figure 4:
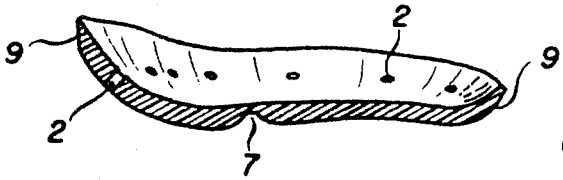
FIG. 4 is a cross-section along axis IV–IV of FIG. 3.

FIG. 4 shows, as a cross-section, along IV—IV of FIG. 3, the transverse profile which is obtained after the insole has become deformed.

In a variant which is not shown, the original profile of the insole may be moulded around the foot before it is placed in the shoe.

I claim:

1. A removable insole for shoes, having an original profile which is of a first shape with two planar sides and consisting of a thin continuous strip of foam plastic in the general shape of a foot, said foam plastic having the property of becoming permanently deformed on contact between one of its sides and a foot having toes and an arch and finally adopting the profile thereof, said strip having a continuous groove along at least part of its border and inside the perimeter defined by said border and an arc-shaped groove which diverges at one end from said continuous groove and defines two zones, one of which corresponds to the arch of the foot, said grooves being configued and dimensioned to allow the insole to change shape more easily and said zones being of different densities with respect to each other.

2. An insole as in claim 1, wherein said groove along at least a part of said border defines a shape which corresponds with the inside sole area of said shoe.

3. An insole as in claim 2, wherein said zones are of at least two different heights and densities, the higher zone having the lower density.

4. An insole according to claim 1, in which said zones have different thicknessess.

5. An insole according to claim 1, in which said thin strip is the product of a pressing operation.

6. An insole according to claim 1, which is the product of a preheating operation.

7. An insole according to claim 1 in which the side of said insole which comes into contact with the foot is covered with a thin layer of a material which absorbs perspiration and eliminates odors.

8. An insole according to claim 1, in which the edges are bevelled.

* * * * *